US007318668B2

(12) United States Patent
Bielozer

(10) Patent No.: US 7,318,668 B2
(45) Date of Patent: Jan. 15, 2008

(54) AGITATOR-INCORPORATING CONTAINER

(75) Inventor: James R. Bielozer, North Olmsted, OH (US)

(73) Assignee: Woodman Agitator Incorporated, Avon, OH (US)

( * ) Notice: Subject to any disclaimer, the term of this patent is extended or adjusted under 35 U.S.C. 154(b) by 691 days.

(21) Appl. No.: 10/438,506

(22) Filed: May 15, 2003

(65) Prior Publication Data

US 2004/0228209 A1 Nov. 18, 2004

(51) Int. Cl.
*B01F 7/20* (2006.01)

(52) U.S. Cl. ..... 366/331

(58) Field of Classification Search ..... 366/244, 366/247–254, 308, 331; 285/137.11, 143.1, 285/386, 390

See application file for complete search history.

(56) References Cited

U.S. PATENT DOCUMENTS

| | | | | |
|---|---|---|---|---|
| 150,517 | A * | 5/1874 | Brooks | 137/625.31 |
| 1,771,321 | A * | 7/1930 | Snow | 366/263 |
| 2,146,372 | A * | 2/1939 | Ingraham | 366/331 |
| 2,493,210 | A | 1/1950 | Woodman | 259/107 |
| 2,501,016 | A | 3/1950 | Woodman | 259/108 |
| 2,760,761 | A | 8/1956 | Woodman | 259/107 |
| 2,760,762 | A | 8/1956 | Woodman | 259/107 |
| 3,295,836 | A * | 1/1967 | Langella | 366/248 |
| 4,290,706 | A | 9/1981 | Wandl | 401/4 |
| 5,489,151 | A | 2/1996 | Weber | 366/247 |
| 5,839,825 | A | 11/1998 | Krzywdziak | 366/247 |

OTHER PUBLICATIONS

Marks'Standard Handbook for Mechanical Engineers, 10th edition, McGraw-Hill, 1996, pp. 8-8 to 8-26.*

Woodman Agitator Inc. (the assignee of the present invention) product pamphlet featuring #1 Single Pin, #2W Blad, #6 Light Duty, #5 Heavy Duty, Air Motor, No. 3 Agitator System, and Custom Nylon Top and Bottom Bearings, no date available.

Woodman Agitator Inc. (the assignee of the present invention) Direct Mount Air Motors product pamphlet featuring Model LZB33 and Model 1UP, no date available.

* cited by examiner

*Primary Examiner*—David Sorkin
(74) *Attorney, Agent, or Firm*—Renner, Otto, Boisselle & Sklar

(57) ABSTRACT

A container (10) includes a drum (12) and an agitator (14) positioned within the drum (12)for the mixing of the paint or other liquid contained therein. A one-piece conversion device (16) is installed in the drum's central opening (30), which is defined by a flange (32) having internal threads (34) of a certain diameter. The plug (16) comprises an annular base portion (70) and a hollow elongated portion (72), which together define a passageway (74). The annular base portion (70) has external threads (78) corresponding to the flange's internal threads (34) and internal threads (76) having a different diameter corresponding to a motor mounting component (54).

15 Claims, 3 Drawing Sheets

AGITATOR-INCORPORATING CONTAINER

FIELD OF THE INVENTION

This invention relates generally as indicated to an agitator-incorporating container and, more particularly, to a container comprising a drum and a straight-shaft agitator positioned within the drum.

BACKGROUND OF THE INVENTION

Paint and other liquid mixtures can be stored in a container having a cylindrical side wall, a circular head wall, and a circular bottom wall. Such a container is commonly called a "drum" and the walls are formed from sheet metal, such as steel. A typical industrial size for such a container is a fifty-five gallon drum. The liquid mixtures (e.g., paint) often contain materials which tend to settle to the bottom by gravity, whereby an agitator is incorporated into the container design so that the liquid can be mixed prior to its use.

A popular agitator design includes a shaft and an impeller attached to the shaft. The bottom end of the shaft is supported rotatably by the drum's bottom wall, and the upper end of the shaft is adapted for coupling to a motor drive shaft. To operate the agitator, a motor is mounted on the drum's head wall and the agitator shaft is coupled to the motor's drive shaft. Upon activation of the motor, rotational motion is transferred to the agitator shaft, causing the impeller to turn and thereby agitating the liquid. The shaft and impeller can be designed to be removable from the drum between agitation cycles. However, of particular relevance in the present case is an agitator design wherein the shaft and impeller remain in the drum, and only the motor is removed between agitation cycles.

The drum's head is designed to afford convenient mounting of the motor and to allow access to the agitator shaft for coupling thereto. To this end, the head wall typically includes a central opening defined by an annular flange, which is attached to the surrounding circular sheet metal edge. The flange includes interior threads (i.e., threads on its radially inward surface), which engage with exterior threads on a mounting component of the motor. Upon mounting of the motor, its drive (or coupling) shaft extends through the central opening and is coupled to the agitator shaft so that rotational motion may be transferred thereto.

Accordingly, the diameter of the drum's threaded flange must be compatible with the diameter of the motor's threaded mounting component. For example, in the paint industry, many motors are designed for mounting within an 1½ inch threaded flange. If a drum has a different sized flange (e.g., 2 inches), the motors mountable on an 1½ inch flange cannot be used, whereby such a drum probably would not be purchased. In addition to convenient motor-mounting, a drum design also must incorporate means for maintenance of the agitator shaft in an upright position so that, when the motor is coupled to the drum, the agitator shaft will be positioned for coupling to the motor shaft. This can be accomplished by installing (e.g., welding) a metal bracket to the interior surface of the drum's head wall, which will hold the shaft upright within the drum.

SUMMARY OF THE INVENTION

The present invention provides a one-piece conversion device that quickly and easily allows a drum having a flange with one diameter of internal threads to be compatible with a motor having a mounting component with a different diameter of external threads. The conversion device of the present invention additionally includes a portion that supports the agitator shaft in an upright position when the motor is not mounted thereto. Furthermore, the conversion device may be installed easily by simply screwing it into position in the threaded flange. No special drum design nor installation procedures are required. Still further, in the preferred plastic construction, the conversion device provides an increased degree of cleanliness, as there is no metal-to-metal rubbing between the shaft and the device.

More particularly, the present invention provides a container that comprises a drum, an agitator, and a conversion device. The drum includes a top wall having a central opening defined by a flange having internal threads of a certain diameter. The agitator is positioned within the drum and includes a shaft adapted for coupling to the shaft of a motor. The agitator shaft is straight (i.e., extends vertically between the drum's top and bottom walls) and the impeller blades extend outwardly (i.e., non-vertically) therefrom.

The one-piece conversion device includes an annular portion and a hollow elongated portion extending therefrom, and these portions together define a passageway. The annular portion has external threads corresponding to the internal threads of the flange (e.g., 2 inches) and internal threads of a different diameter corresponding to the external threads of a motor's mounting component. The conversion device can be formed in one piece during a molding process and/or can be made of plastic, nylon, carbon steel, stainless steel, copolymer, polypropylene or polyethylene. For example, the conversion device can be made of plastic or nylon and formed in one piece during an injection molding process.

The annular portion is positioned within the central opening, with its external threads engaged with the internal threads of the flange. The agitator shaft extends into the elongated portion, whereby the agitator shaft is maintained in an upright position. The internal threads of the conversion device can be used to mount a motor to the drum and, when such mounting is done, the motor's shaft extends into the elongated portion and is coupled to the agitator shaft. When the motor is not mounted on the drum, a cap can be used to close the open top of the plug's passageway.

These and other features of the invention are fully described and particularly pointed out in the claims. The following description and drawings set forth in detail a certain illustrative embodiment of the invention, which is indicative of but one of the various ways in which the principles of the invention may be employed.

DRAWINGS

FIG. 1 is a side view (partly in section) of a container according to the present invention, the container comprising a drum and an agitator positioned therewith in.

DETAILED DESCRIPTION

Figure 1:
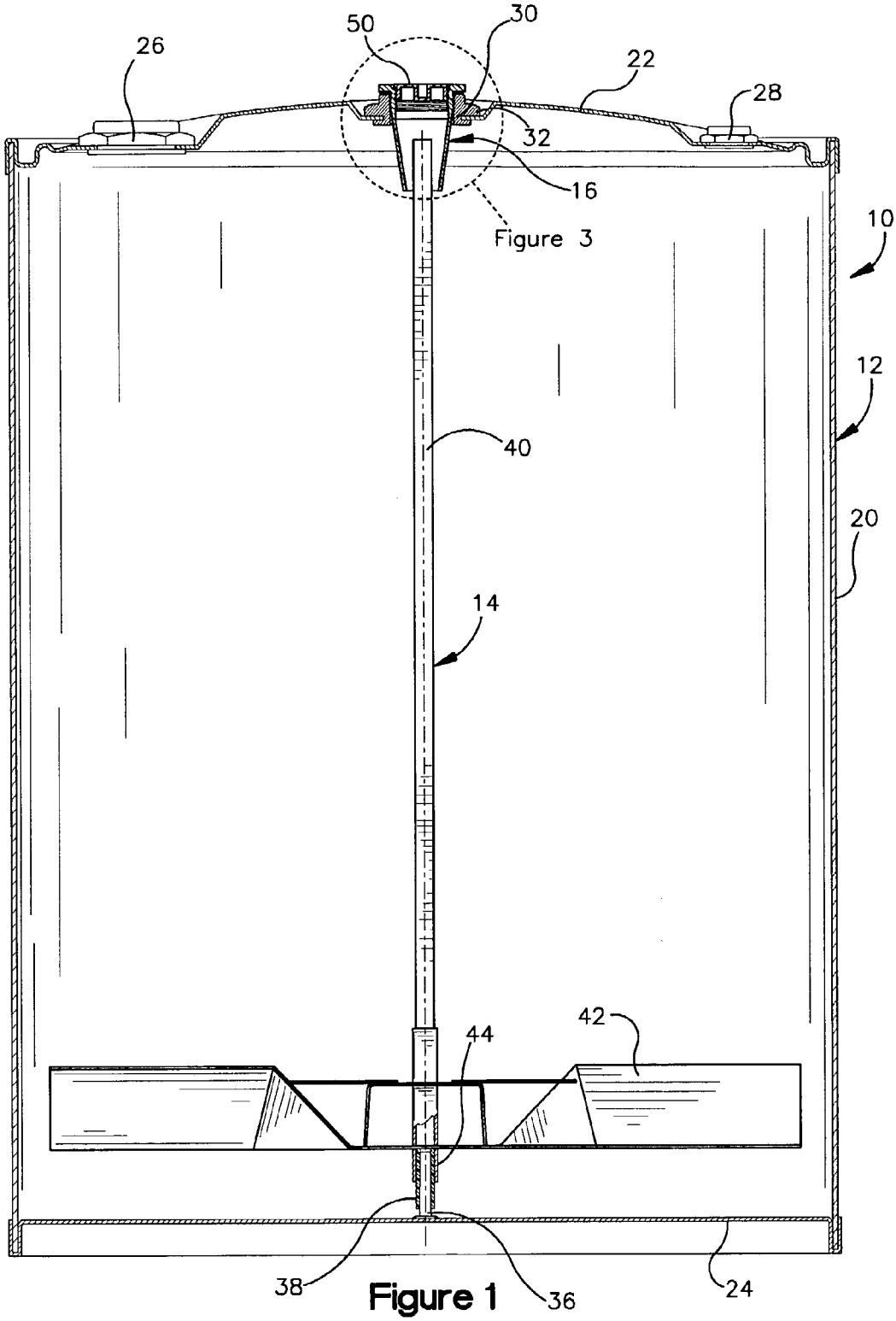

Referring now to the drawings and initially to FIG. 1, a container 10 according to the present invention is shown. The container 10 comprises a drum 12 and an agitator 14 positioned within the drum 12. The container 10 further incorporates a conversion device 16 according to the present invention, which allows the container 10 to be compatible with a particular motor-mounting arrangement.

The illustrated drum 12 includes a cylindrical side wall 20, a circular head wall 22, and a circular bottom wall 24 sized to correspond to a desired drum capacity (e.g., a fifty-five gallon capacity, a thirty gallon capacity, a fifteen gallon capacity, etc.). The head wall 22 can have two diametrically positioned openings 26 and 28 (e.g., a fill opening and a vent opening) and a central opening 30. As is best seen by referring briefly to FIG. 3, the central opening 30 is defined by an annular flange 32, which is attached to the surrounding circular sheet metal edge and which includes internal threads 34 of a certain diameter. A pivot pin 36 extends upwardly from the bottom wall 24, and a cylindrical bearing 38 can surround the pivot pin 36, but a bearing might not be needed in many situations.

The agitator 14 comprises a shaft 40 and impeller blades 42 attached thereto. The shaft 40 is straight (i.e., extends vertically between the top wall 22 and the bottom wall 24 of the drum 12) and the impeller blades 42 project outwardly (i.e., non-vertically) from the shaft 40. In the illustrated embodiment, a pair of impeller blades 42 project perpendicularly from the shaft 40. However, fewer or more blades and/or non-perpendicular projecting is possible with and contemplated by the present invention. In any event, the impeller blades 42 prevent the agitator 14 from being removed from the drum 12 without removal of its top wall 22.

The bottom end of the shaft 40 is supported rotatably by the drum's bottom wall 24 and, in the illustrated embodiment, this rotational support is accomplished by a sleeve 44, which rotatably receives the pivot pin 36. The sleeve 44 can be a separate component (as shown) or can be integrally formed in the shaft 40 by providing its bottom end with a tube-like construction. Alternatively, (and not specifically shown) a bracket with an opening to receive the shaft's bottom end rotationally can be welded to the bottom wall 24. These and other designs can be used to attach the shaft 40 to the bottom wall 24 of the drum 12 rotatably.

The upper end of the shaft 40 extends into the conversion device 16 and is adapted for motor-coupling. For example, in the illustrated embodiment, the shaft 40 has a square cross-sectional shape whereby the upper end portion 46 of the shaft 40 also has such a cross-sectional shape. While some vertical movement is expected, the shaft 40 cannot be lifted too high, as it will disengage from its bottom rotational attachment. To this end, although not specifically shown in the drawings, a washer or other type of stop may be provided on the shaft 40 to limit its upward motion.

Figure 2:
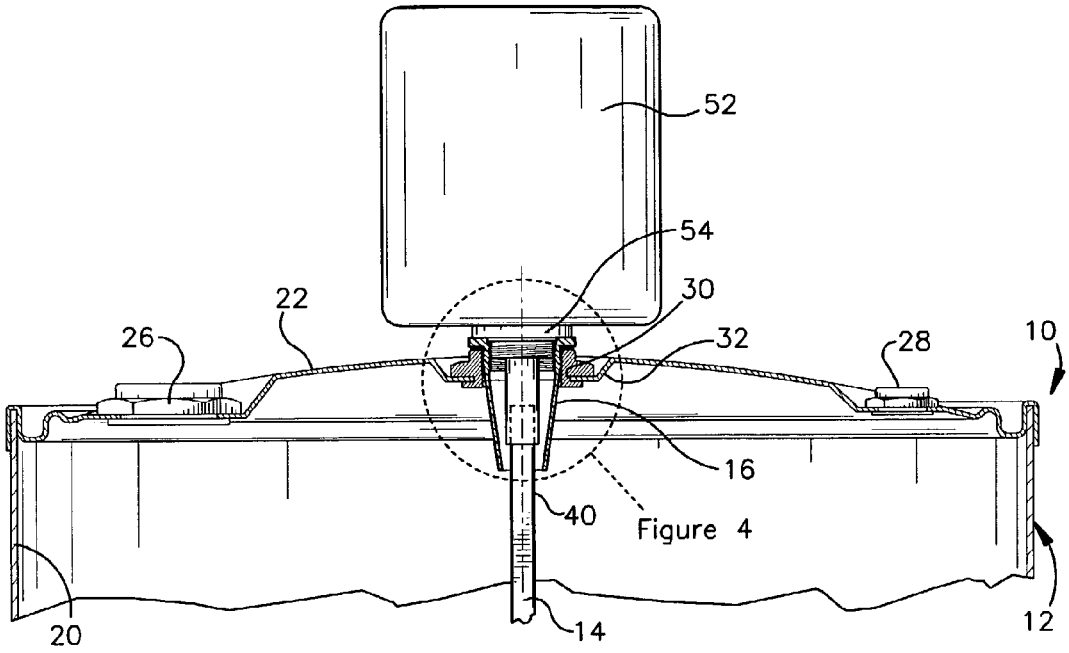
FIG. 2 is side view of an upper portion of the container with a motor mounted thereon.

A plug 50 is provided to close the conversion device 16 when the agitation process is not being performed. To prepare the container 10 for agitation, the plug 50 is removed from the conversion device 16 and, as shown in FIG. 2, a motor 52 is mounted thereon. As is best seen by referring briefly to FIG. 3, the motor 52 includes a mounting component 54, which comprises an annular flange 56 with external threads 58 in the illustrated embodiment. The external threads 58 have a different diameter than the diameter of the flange 32.

The motor 52 also includes a drive (or coupling shaft) 60, which extends through and past the mounting component 54 and into the conversion device 16. The drive (or coupling) shaft 60 is adapted for coupling to the agitator shaft 40 so that rotational motion may be transferred thereto. For example, in the illustrated embodiment the shaft 60 includes an integral coupling portion 62 having a square recess for non-rotational receipt of the square coupling portion 46 of the shaft 40.

Figure 5:
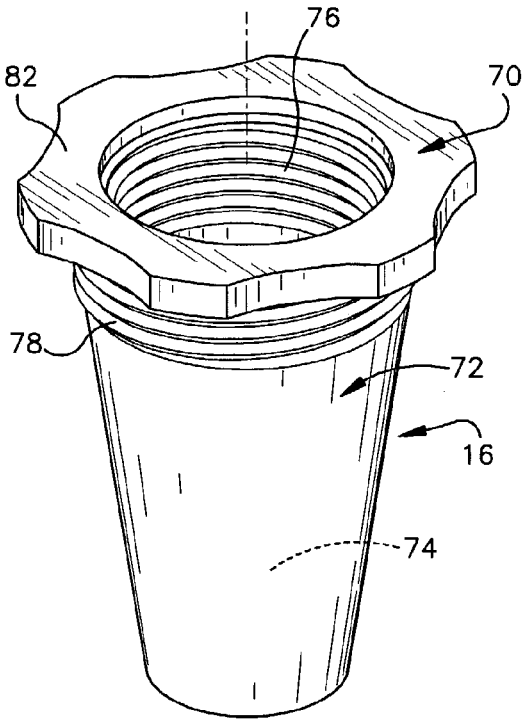
FIG. 5 is a perspective view of the conversion device.
Figure 6:
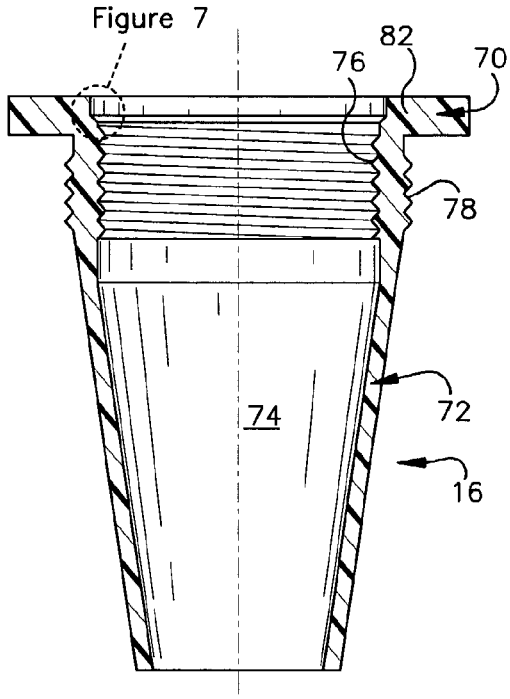
FIG. 6 is a sectional view of the conversion device.
Figure 7:
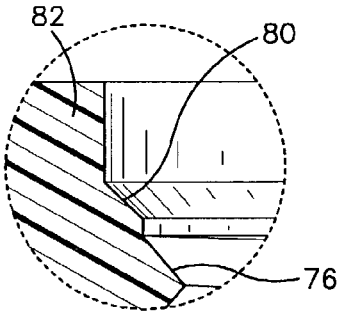
FIG. 7 is a close-up view of a region of the conversion device.

Referring now to FIGS. 5 and 6, the conversion device 16 is shown isolated from the rest of the container 10. The illustrated conversion device 16 comprises an annular base portion 70 and an elongated hollow portion 72 extending therefrom, these portions 70 and 72 together defining a passageway 74. The annular base portion 70 includes internal threads 76 and external threads 78. As explained in more detail below, the internal threads 76 correspond to the external threads 58 on the motor's mounting component 54, and the external threads 78 correspond to the internal threads 34 on the drum's annular flange 32. The internal threads 76 form a threaded section of the passageway 74, and a ledge 80 can be provided just above this threaded section. (See FIG. 7.) An installation collar 82 can be provided around the upper end of the base portion 70.

In the illustrated embodiment, the elongated hollow portion 72 has a cone-like shape; that is, it tapers inwardly towards its distal end. That being said, other elongated shapes are possible with, and are contemplated by, the present invention. The important geometric consideration is that the passageway 74 accommodates the protruding length of the driving (or coupling) shaft 60 and a sufficient length of the agitator shaft 40 to support it in an upright position when disconnected from the drive (or coupling) shaft 60.

The conversion device 16 has a unitary construction; that is, it is formed in one piece. The plug 16 can be made from an engineered plastic or commodity (e.g., homopolymer, copolymer, etc.), nylon, carbon steel, stainless steel, high-impact polypropylene, or high-density polyethylene (HDPE). For example, the one-piece part can be made preferably of plastic by an injection molding process. It is noted that a non-steel construction (e.g., plastic, nylon, copolymer, etc.) may reduce metal-to-metal contact during agitation, thereby providing significantly cleaner operations.

Figure 8:
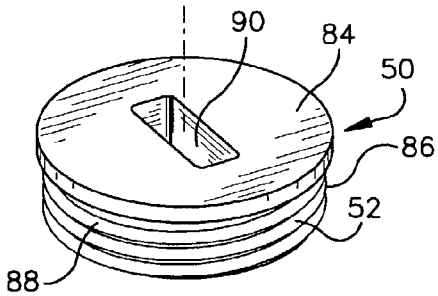
FIG. 8 is a perspective view of a cap that can be used to close a passageway in the conversion device.

Referring now to FIG. 8, the plug 50 is shown isolated from the plug 16 and the rest of the container 10. The plug 50 comprises a circular top wall 84 and a cylindrical wall 86 extending downwardly therefrom. The cylindrical wall 86 includes external threads 88, which correspond to the plug's internal threads 76. A rectangular array of walls define a notch 90 in the top wall 84 that is adapted for the receipt of an installation tool. The plug 50 can be made from an engineered plastic or commodity (e.g., homopolymer, copolymer, etc.), nylon, carbon steel, stainless steel, high-impact polypropylene, or high-density polyethylene (HDPE); can be made of the same material as the plug 16; and/or can be injection molded.

Figure 3:
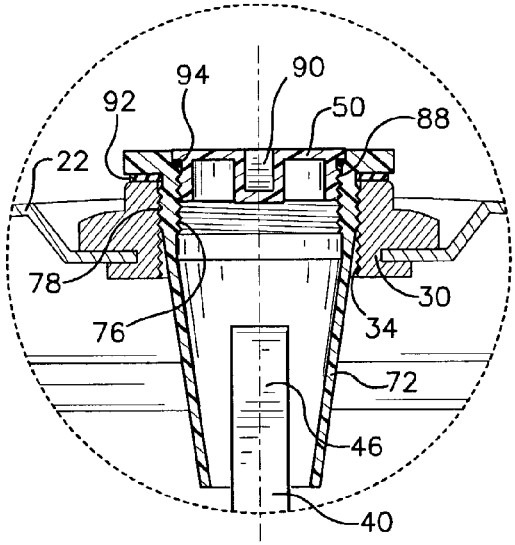
FIG. 3 is a close-up view of the head wall of the container as shown in FIG. 1.
Figure 4:
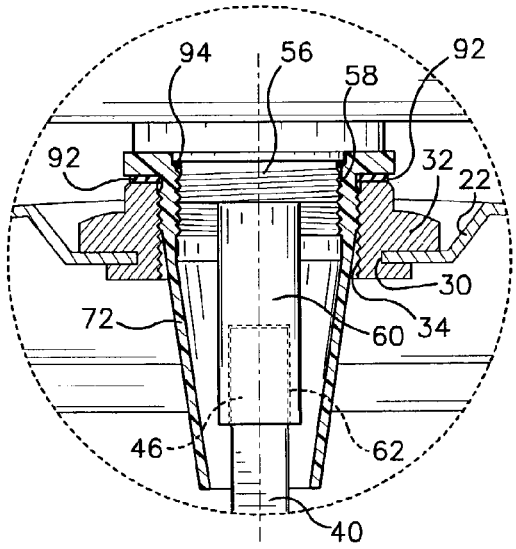
FIG. 4 is a close-up view of the head wall of the container as shown in FIG. 2.

Referring now back to FIGS. 3 and 4, in order to affix the conversion device 16 to the drum 12 the hollow portion 72 is inserted through the head's central opening 30 until the external threads 78 of the plug's annular base portion 70 contact the internal threads 34 of the flange 32. The plug 16 then is screwed into position within the flange 32. A washer 92 (or other suitable seating component) can be provided between the upper surface of the flange 32 and the bottom surface of the plug's installation collar 82.

When the agitator 14 is not being used (FIG. 3), the plug 50 can be used to close the open upper end of the passageway 74. Specifically, the plug 50 can be turned (via an appropriate tool inserted into its notch 90) for engagement between the internal threads 76 of the plug 16 and the external threads 88 of the plug 50. An O-ring 94 or other suitable sealing member can be positioned on the plug's ledge 80 so that a seal is formed between the plug 16 and the plug 50. In any event, regardless of whether the plug 50 or any other closing device is used, the agitator shaft 40 extends upwardly into the passageway 74. In this manner, the shaft 40 remains in the upright position despite any tilting/vibration, and its coupling portion 46 is positioned appropriately for future motor mounting.

To use the agitator 14 (FIG. 4), the plug 50 is removed by unscrewing it from the plug 16 and the motor 52 is mounted to the drum 12. More specifically, the motor's mounting component 54 is attached to the drum 12 by engaging its external threads 58 with the internal threads 76 of the plug 16. The motor shaft 60 extends into the passageway 74, and its coupling sleeve 62 mates with the coupling portion 46 of the agitator 14.

One now may appreciate that the present invention provides a one-piece plug 16, which quickly and easily allows a drum 12, having a flange 32 with one diameter of internal threads 34, to be compatible with a motor 52, having a mounting component 54 with a different diameter of external threads 58. The one-piece plug 16 of the present invention additionally maintains the agitator shaft 40 in a motor-coupling position (i.e., upright) when the motor 52 is not mounted thereto. Furthermore, the plug 16 may be installed easily during manufacture of the container 10 simply by screwing it into position in the threaded flange 32.

Although the invention has been shown and described with respect to certain preferred embodiments, it is obvious that equivalent and obvious alterations and modifications will occur to others skilled in the art upon the reading and understanding of this specification. The present invention includes all such alterations and modifications and is limited only by the scope of the following claims.

The invention claimed is:

1. In combination, a container and a motor;

the container comprising a drum, an agitator, and a one-piece conversion device;

the drum including a top wall having a central opening defined by a flange having internal threads of a certain diameter;

the agitator being positioned within the drum and including a vertical shaft adapted for coupling to the shaft of a motor;

the one-piece conversion device including an annular portion and a hollow elongated portion extending therefrom, wherein these portions together define a passageway;

the annular portion having external threads with a diameter corresponding to the internal threads of the flange;

the annular portion also having internal threads with a different diameter than the internal threads of the flange;

the annular portion being positioned within the central opening with its external threads engaged with the internal threads of the flange;

the agitator shaft extending into the elongated portion, whereby the elongated portion maintains the agitator shaft in an upright position;

the motor including a mounting component having external threads corresponding to the internal threads of the conversion device and threadably engaged therewith; and the motor also including a shaft, which extends into the elongated portion and which is coupled to the agitator shaft.

2. The combination set forth in claim 1, wherein the internal threads form a threaded section of the passageway, wherein a ledge is positioned just above this threaded section, and wherein a sealing ring is positioned within this ledge.

3. The combination set forth in claim 1, wherein the conversion device further comprises a collar surrounding the upper end of the annular base portion.

4. The combination set forth in claim 1, wherein the elongated hollow portion has a cone-like shape.

5. The combination set forth in claim 1, wherein the conversion device is formed in one piece during a molding process.

6. The combination set forth in claim 1, wherein the conversion device is formed in one piece during an injection molding process.

7. The combination set forth in claim 1, wherein the conversion device is made of plastic, carbon steel, or stainless steel.

8. The combination set forth in claim 1, wherein the conversion device is made of a polymer.

9. The combination set forth in claim 1, wherein the conversion device is made of plastic and is formed in one piece during an injection molding process.

10. The combination set forth in claim 1, wherein the conversion device is made of nylon.

11. The combination set forth in claim 1, wherein the conversion device is formed in one piece and further comprises a plug to close the top opening in the insert's passageway, the plug comprising a cylindrical wall with external threads corresponding to the internal threads of the conversion device and threadably engaged therewith.

12. The combination set forth in claim 11, wherein the plug is made of the same material as the conversion device.

13. The combination set forth in claim 11, wherein the plug includes a notch for insertion of a tool for installation and removal of the plug from the conversion device.

14. The combination set forth in claim 1, wherein the agitator additionally comprises at least one impeller blade projecting outwardly from the shaft.

15. The combination set forth in claim 1, wherein the impeller blade(s) project perpendicularly outward from the shaft.

* * * * *